United States Patent [19]

Hunt et al.

[11] Patent Number: 4,885,877

[45] Date of Patent: Dec. 12, 1989

[54] FRAME STRUCTURE FOR BUILDINGS

[75] Inventors: Rowland D. Hunt; Kenneth Gardner, both of Santa Barbara, Calif.

[73] Assignee: Clamshell Partners Ltd., Santa Barbara, Calif.

[21] Appl. No.: 228,264

[22] Filed: Aug. 3, 1988

[51] Int. Cl.[4] ..... E04B 1/347; E04B 1/32

[52] U.S. Cl. ..... 52/2; 52/63; 52/86; 135/102

[58] Field of Search ..... 47/17; 52/43, 86, 2; 160/392, 395, 371; 135/111, 97, 113, 102

[56] References Cited

U.S. PATENT DOCUMENTS

| | | | |
|---|---|---|---|
| 2,225,972 | 12/1940 | Brogren | 135/DIG. 1 |
| 3,696,857 | 10/1972 | Tarte | 160/371 |
| 3,802,450 | 4/1974 | Huddle | 135/97 |
| 4,036,244 | 7/1977 | Huddle | 52/63 |
| 4,092,992 | 6/1978 | Huddle | 135/DIG. 1 |
| 4,229,914 | 10/1980 | Lucas | 52/63 |
| 4,267,876 | 5/1981 | Bloomfield | 160/395 |
| 4,583,331 | 4/1986 | Hunt | 52/63 |
| 4,593,710 | 6/1986 | Stafford | 52/63 |
| 4,644,706 | 2/1987 | Stafford | 52/63 |

*Primary Examiner*—John E. Murtagh

[57] ABSTRACT

A frame structure comprises a plurality of parallel, spaced apart, arched frame assemblies composed of pairs of frames. This enables existing frame members to be used for longer spans and/or stronger structures. The pairs of frames are connected together at spaced apart positions. Conveniently the connections between frames occurs adjacent to the ends of sections forming the frames and a combined arrangement can be used for connecting frames and joining sections. Fabric panels extend between the frames of a pair and between pairs of frames. The panels have integral tensioning means. The frames are pivotally fastened to ground support means.

17 Claims, 15 Drawing Sheets

FRAME STRUCTURE FOR BUILDINGS

BACKGROUND OF THE INVENTION

1. Field of the Invention

This invention relates to frame structures for buildings, and in particular to such frame structures having double frames.

2. Related Art

It has been proposed to provide mobile or temporary buildings with spaced frames, the spaces between the frames being filled by a fabric panel, or fabric panels. One example of such a building is described in U.S. Pat. No. 4583331, issued Apr. 22nd 1986 (in the name of the present assignees).

The frames are formed by connecting sections together to form arched frames, giving a clear span. For convenience, efficiency and economic reasons, it is preferred that the various sections be standardized, having a common cross-section. The span of a building will depend on the number of sections in each wall portion and the number of sections in each roof portion. However there is a limit to the span which can be provided. While internal supports can be provided, these interfere with the clear space within the building and are therefore to be avoided. The alternative is, therefore, to increase the cross-section of the sections to make them stronger. Thus it is necessary to stock sections of different cross-sections to satisfy different requirements.

SUMMARY OF THE INVENTION

The present invention provides an arrangement whereby a standard cross-section is maintained for all the frame sections. To increase the span capability of a frame structure two frames are provided at each of what would normally be a single frame position. The two frames are spaced a short distance but connected together at spaced positions along the length of a frame. The pairs of frames are spaced apart, pivotally supported on fixed group supports. The panels between pairs of frames are tensioned by integral tensioning means, such as inflatable tubes and also panels inserted between the frames of a pair are tensioned by integral tensioning means, such as inflatable tubes. The frames are assembled at ground level and pulled up in a predetermined sequence, and connected together. Fabric panels are inserted and then tensioned.

BRIEF DESCRIPTION OF THE DRAWINGS

The invention will be readily understood by the following description of certain embodiments, by way of example, in conjunction with the accompanying drawings, in which:

FIG. 1 is a side view of a building and could be an entire building if relatively short, with three main panels, or could be part of a longer building. Frames are indicated at 10 and 11, one pair of frames 10 and 11 forming a structural frame arrangement. Spaces between pairs of frames are filled by fabric panels 12 having integral inflatable tubes 13. The space between the frames of a pair is filled by a fabric panel 14, having an integral inflatable tube 15. The frames 10 and 11 are pivotally mounted at their bottom ends at 16, on ground plates 17. Cross member 18 provide rigidity. Cables 19 can be provided also to provide stability, particularly at erection. FIG. 2 illustrates the span of the building, each frame having a straight wall portion 20 at each side and a straight roof portion 21 at each side, the portions connected by curved sections 22. Each wall portion and each roof portion is formed of a number of straight sections joined together. The cross-section of the straight sections and the curved sections is the same.

FIG. 3 shows one form of cross-section for the sections 20, 21 and 22 of FIG. 2. The cross-section is in the form of an I beam, having a central web 25 with flanges 26 and 27 at each end of the web 25. The flanges 26 and 27 are relatively thick and have a central groove 28 and 29 respectively, the grooves having an opening which is reduced in width by inwardly intruding ribs 30. At the functions of the flanges 26 and 27 with the central web, on each side of the web, are substantially circular grooves 31 each groove having a narrow neck 32 giving access to the groove. The sections are formed readily by extrusion.

FIGS. 4 and 5 illustrate a joint between two sections of each frame of a pair, the frames being identified by the same reference numbers as in FIG. 1. The two frames in a pair are aligned and also spaced apart by a spacing tube 40 the spacer tubes engaging with and aligned by elastomer plugs 41 and 42. The plugs 41 and 42 are push fits on members 43 positioned in holes in the central webs of the two frames. A spacer tube, plugs and member are provided on either side of the joint face 44 between sections.

Figure 1:
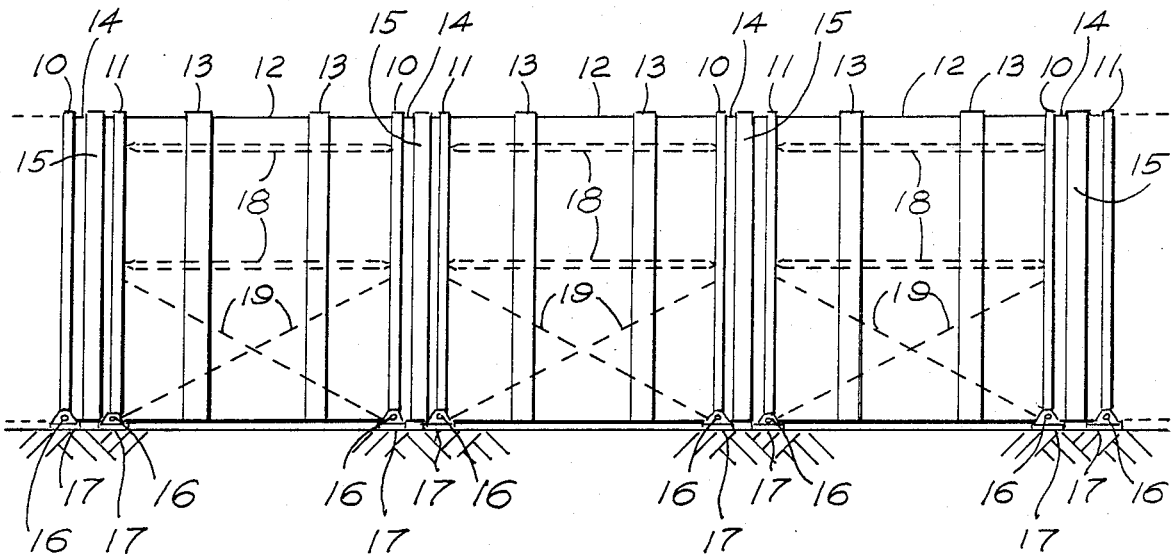
FIG. 1 is a side view of a building, or part of a building, showing the frame arrangement.
Figure 2:
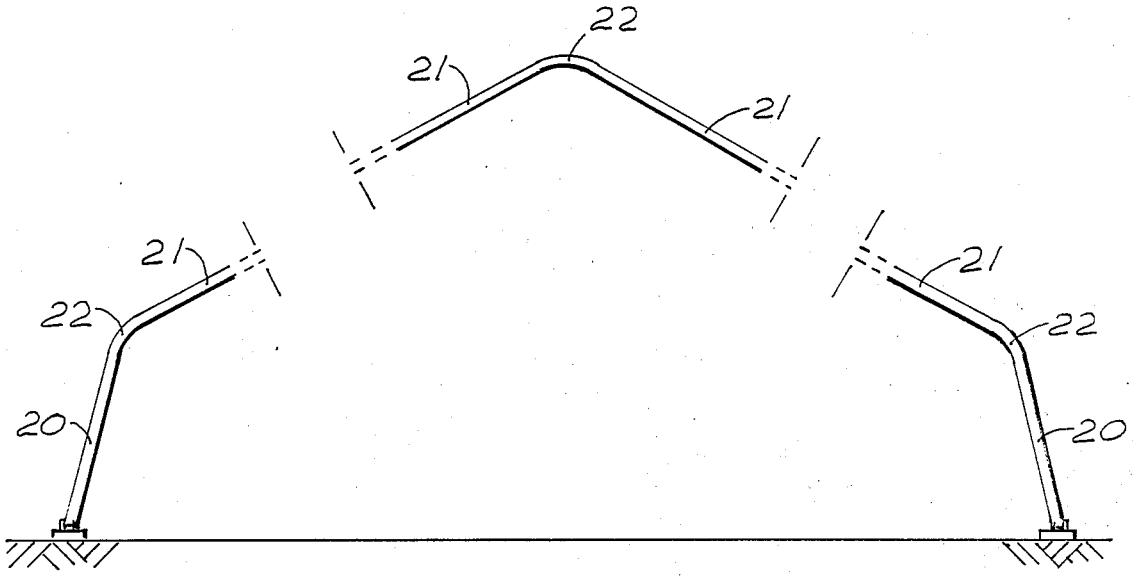
FIG. 2 is a front view of the building as illustrated in FIG. 1.

Clamping the two sections in each frame together, and also clamping the two frames together are two splice plates 50. These plates are generally rectangular in form with formed over edges 51 which engage over the flanges 26 and 27 of the frames. Positioned in the grooves 28 and 29 are nuts 52 and bolts 53 pass through the plates 50 into the nuts. Tightening the bolts 53 causes the central webs 25 to be pushed firmly against the ends of the spacer tubes.

Figure 4:
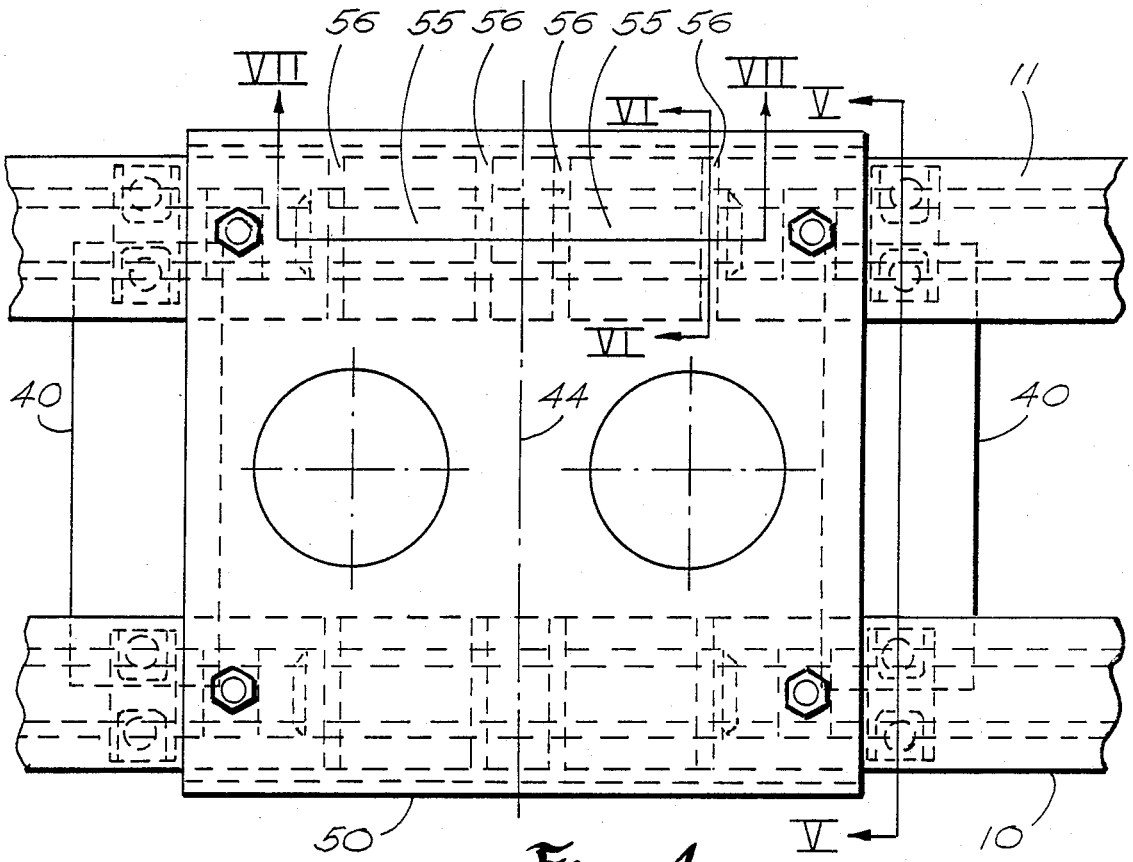
FIG. 4 is a view of the outer surfaces of a pair of frames at a section joint position.
Figure 5:
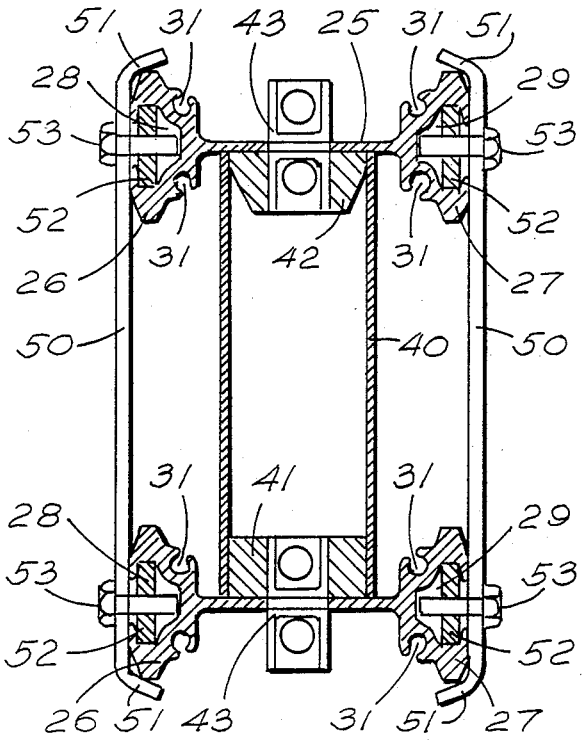
FIG. 5 is across-section on the line V—V on FIG. 4.
Figure 6:
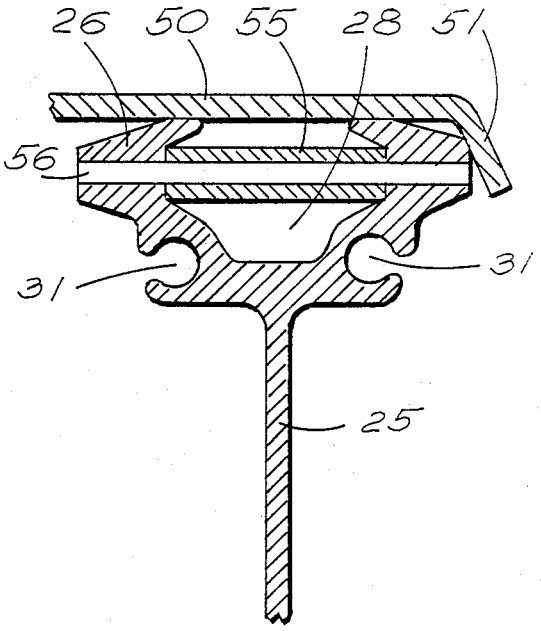
FIG. 6 is a cross-section through part of a frame adjacent to a section joint, on the line VI—VI in FIG. 4.
Figure 7:
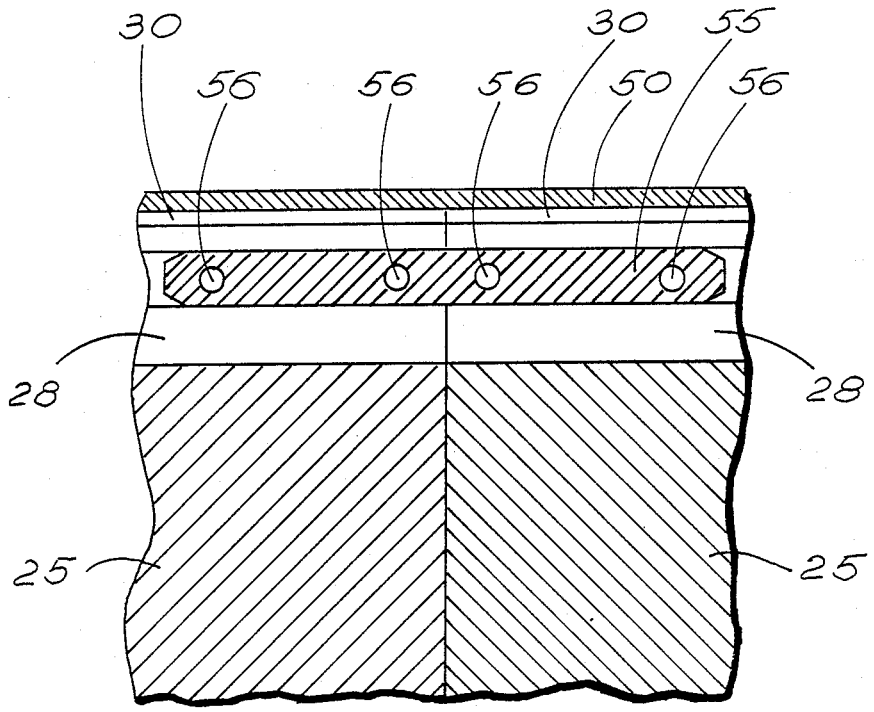
FIG. 7 is a cross section on the line VII—VII in FIG. 4.
Figure 8:
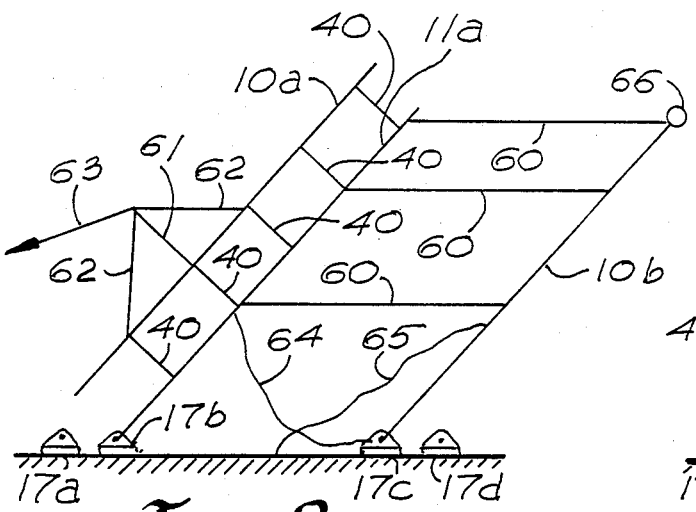
FIGS. 8 to 13 illustrate stages in the erection of frames for a structure.

The sections of a frame are also aligned at a joint, and held together, by internal splice members positioned in the grooves 28 and 29. This is illustrated in FIGS. 6 and 7. An elongate splice member 55, seen also in dotted outline in FIG. 4, is a tight fit into each groove 28 and 29. A splice member is pushed into its groove in the end of one section and pins 56 driven through holes in the flanges 26 and 27 and the splice member 55. Approximately half of the splice member extends from the section and this is pushed into the related groove of the other section. Again pins 56 are driven through holes in the flanges and the splice members.

Thus the sections are held together by the splice members 55 and the frames are held together by the splice plates 50, aligned and spaced by the spacer tubes 40 and elastomer plugs 41 and 42.

Figure 9:
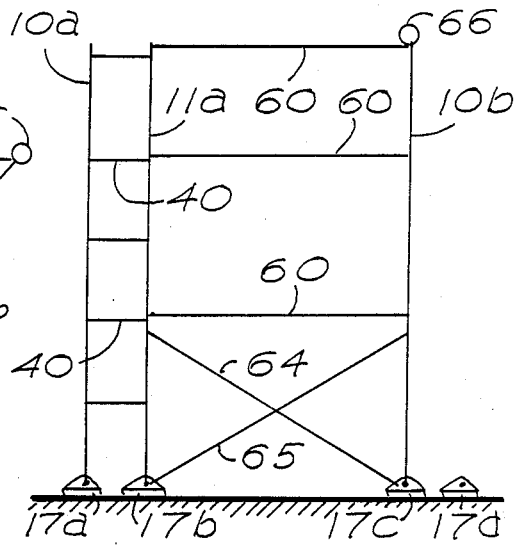

Because of their span, individual frames are quite flexible. It is therefore not advisable to raise frames into position singly. Also, as frames are lifted or pivotted into position it is advisable to provide some form of lateral stability between frames. FIGS. 8 to 13 illustrate one method for raising frames into position. At the start a double frame assembly of frames 10*a* and 11*a* is formed, being connected by spacers 40, and pivotted on ground sections 17*a* at the bottom ends of frame 11*a*. The first frame 10*b* is assembled on the ground and the bars 60 are connected at each end to frames 11*a* and 10*b*. Initially frame 10*b* may need to be supported slightly off of the ground. A short king post 61 is attached to frame 10*a*, a king post on each wall portion, and held in position by members 62. By pulling on the king post as by a rope 63, the two frames 10*a* and 11*a* are pivotted up and so also is frame 10*b*. When the frames are vertical, the two bars are secured at each end giving substantial rigidity. Cross-bracing wires can also be installed, indicated at 64 and 65. Cross wires 64 can be attached at both ends before frames are lifted up but cross wires 65 are attached at on end only until the frames are upright. Cross wires can be provided only in the wall portions, extending from the ground anchors at the lower ends and attached to the frames by bolts passing through the frame, or by anchor bolts positioned in the corner groove 29. Also, when the frames are upright, frame 10*a* is pivotally attached to ground anchor 17*a*. This is illustrated in FIG. 9. A pulley 66 is attached to the top of frame 10*b*.

Figure 10:
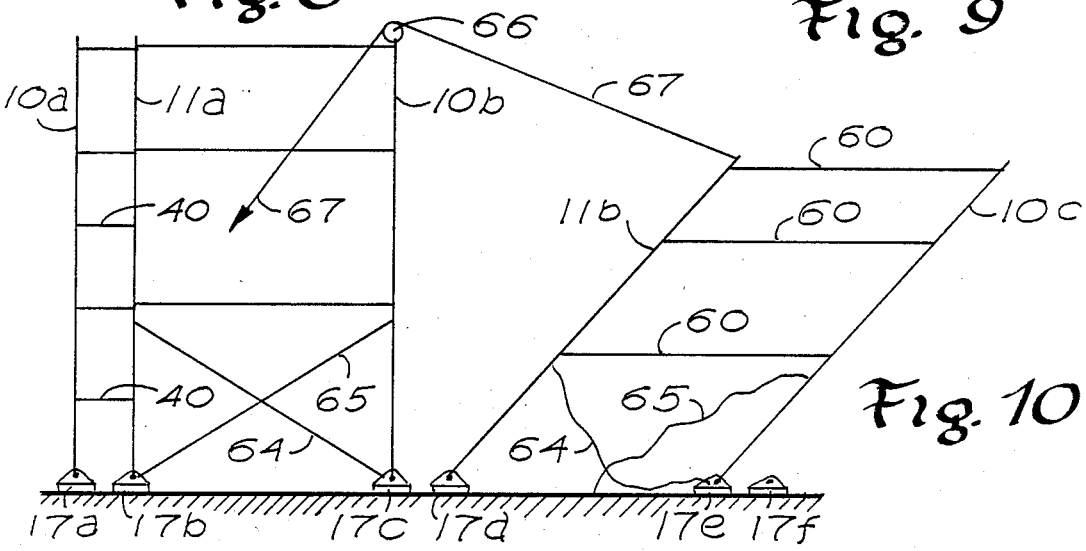

The next two frames 11*b* and 10*c* are assembled on the ground, pivotally attached to ground plates or anchors 17*d* and 17*e* respectively. Tie bars are attached as are cross wires 64 and 65. A rope 67 is passed over pulley 66 and attached to frame 11*b*. Pulling on rope 67 lifts frames 11*b* and 10*c* up into position, being held in position by the bars 60 and cross wires 64 and 65. The final position is as illustrated in FIG. 11, FIG. 10 illustrating an intermediate position.

Figure 11:
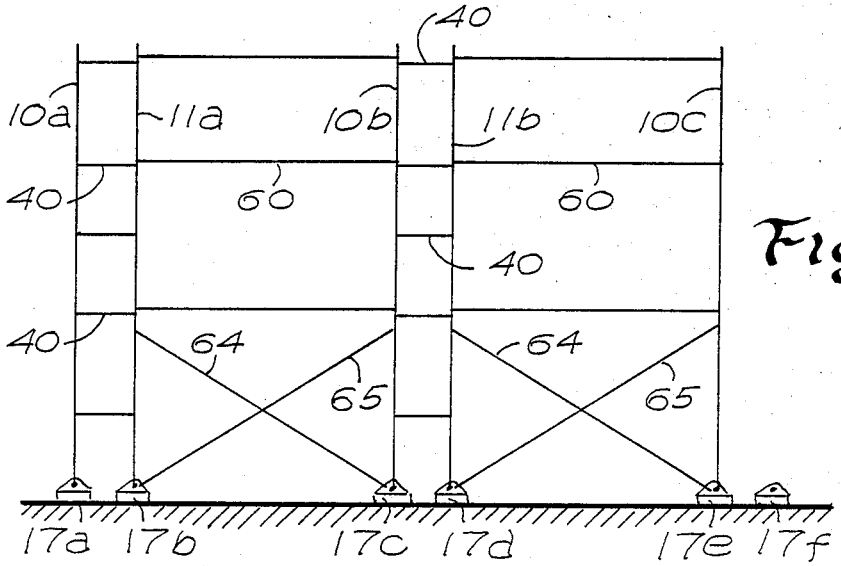
Figure 12:
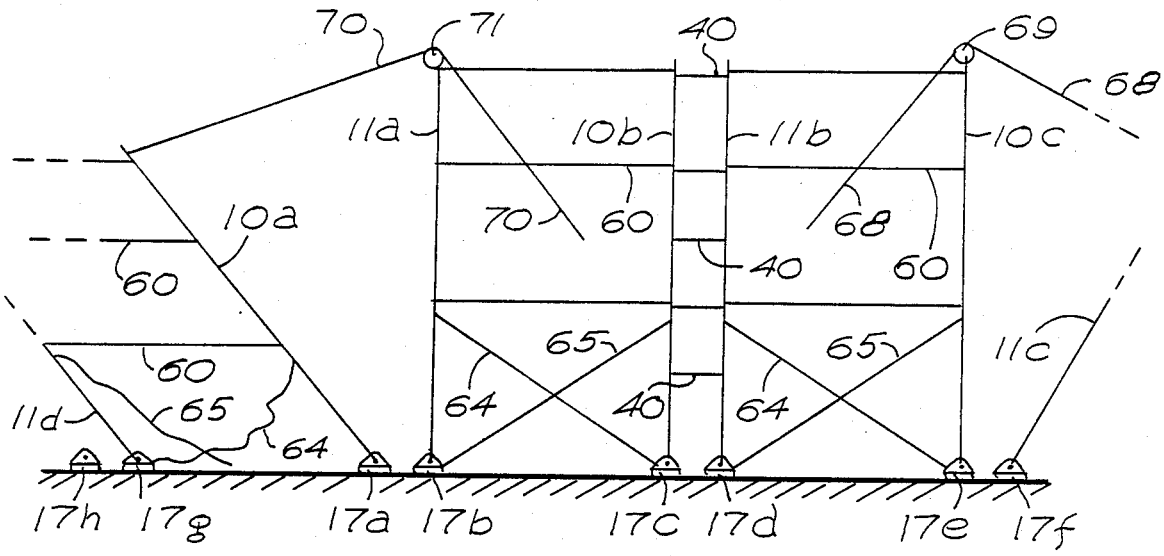
Figure 13:
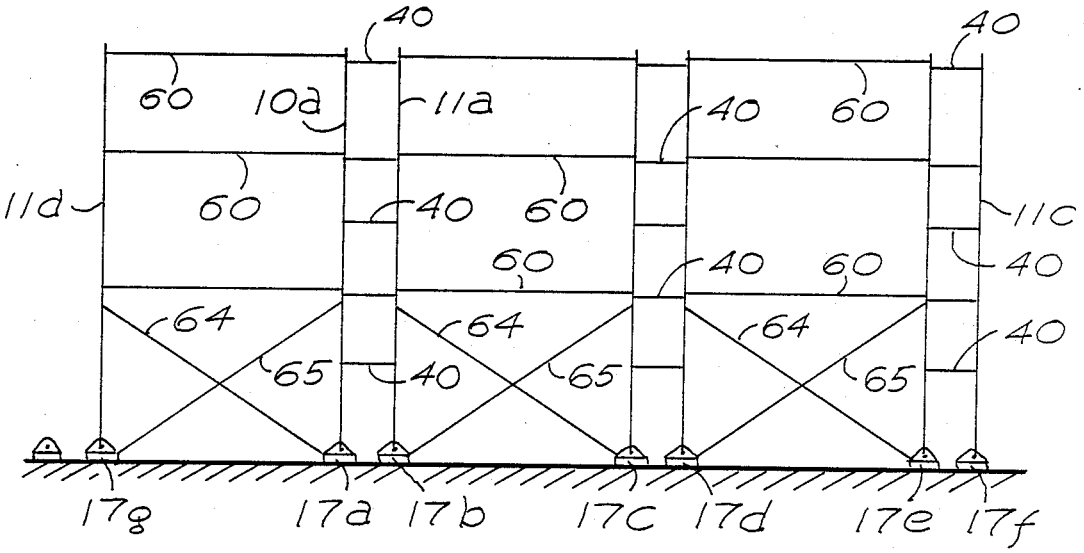

To finish off a building, at the right hand side in FIG. 11, a single frame 11*c* is pulled up, pivotally mounted on ground anchors 17*f*. The frame is raised by a rope 68 passing over a pulley 69 on the frame 10*c*.

Conveniently, a building is erected from the center and frames will be added to the left, in FIG. 11. To do this, frame 10*a* is manually removed, or disconnected from frame 11*a*, and pivotted down towards the ground. A further frame 11*d* is connected to frame 10*a* by the bars 60, and pivotally mounted at its lower ends on ground anchors 17*g*. The two frames, 10*a* and 11*d*, are pulled up by a rope 70 passing over a pulley 71 on frame 11*a*. The building, with frame 11*c* and frames 10*a* and 11*d* in final position, is as in FIG. 13.

Further frames can be added, as desired, using the above sequence. Other methods of assembly can also be used. Either as frames are pulled erected, or on completion of a whole building, or part of a building, fabric panels, corresponding to panels 12 and 14 in FIG. 1, can be installed.

Figure 14:
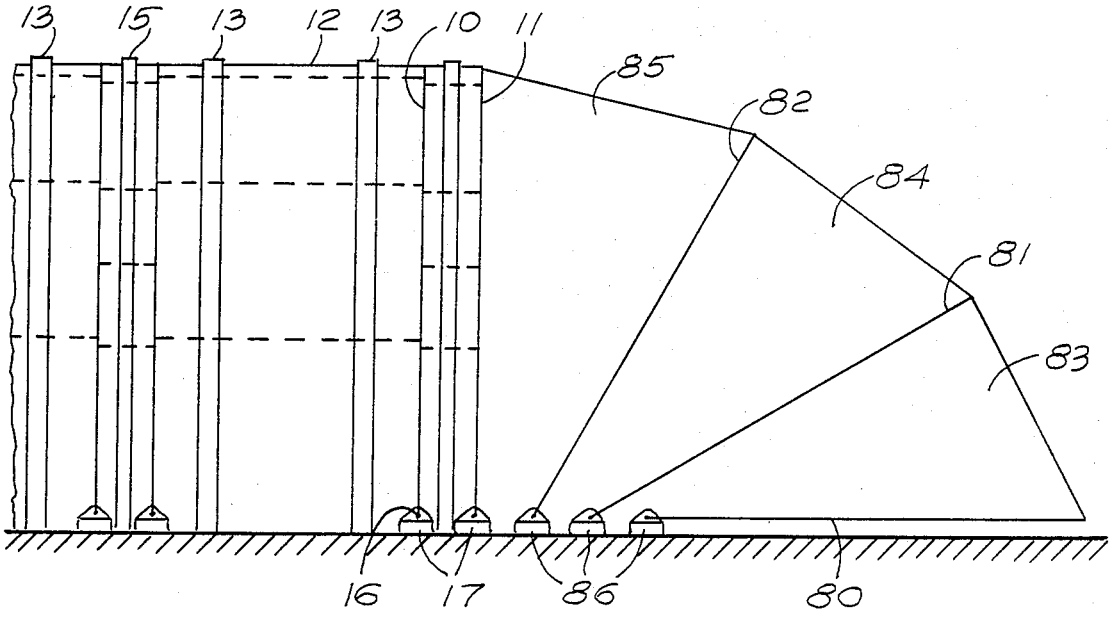
FIG. 14 illustrates one end of a structure with an openable closure.

End closures can be attached to both ends and such closures can be of a permanently closed form, or be openable. FIG. 14 illustrates part of a building, as in FIG. 1, with an openable closure at one end. In this example there are three frames 80, 81 and 82, with fabric panels 83, 84 and 85. The frames are of the same fabric as frames 10 and 11 and panels are inserted in the same manner, as will be described. The frames are pivotally attached at their lower ends to ground anchors 86.

Figure 15:
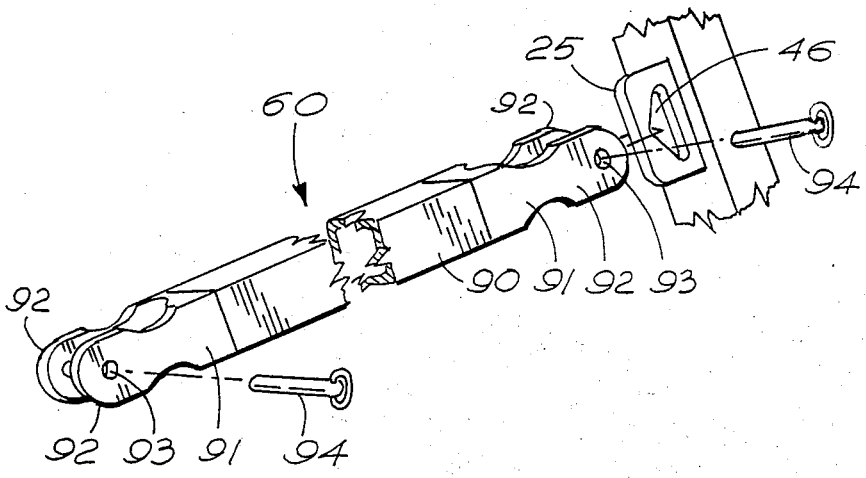
FIG. 15 illustrates a form of tie bar.

FIG. 15 illustrates one form of tie bar 60. In this example, a tie bar comprises a main tubular portion 90 into each end of which is fitted a pivot member 91 which has two spaced parallel legs 92. Each leg has a hole 93, the holes in alignment, for reception of a pin 94. Pins 94 connect the tie bar to the frames via a bracket 95 attached to the frame. The brackets have a slot 46 through which passes the pins 94. The slots provide for some sliding of the pin during erection of frames. It is only possible to have fixed pivotal joints if all the pivots are on the frame center lines.

Figure 16:
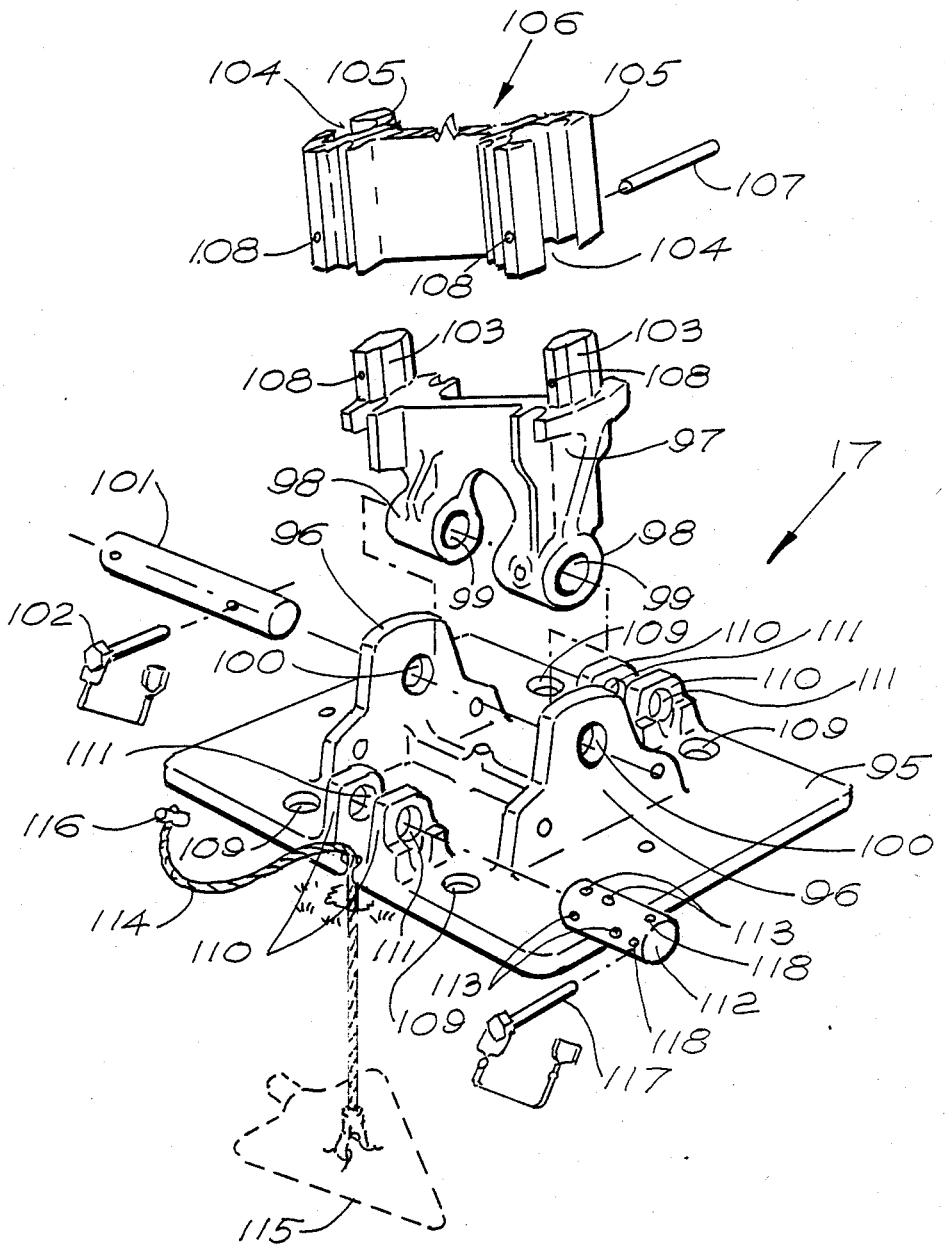
FIG. 16 illustrates one form of ground plates.

FIG. 16 illustrates one form of ground anchor or plate as can be used for pivotal attachment of frames to the ground. The ground plate is firmly located and held in position. The ground plate illustrated in FIG. 16 can accept differing forms of anchorage and also permit tightening of cables extending from the ground plate to a buried positioning member.

A ground plate, illustrated generally at 17, comprises a base plate 95 having a pair of upstanding ribs 96. Between the ribs 96 fits a bracket 97, having two bearings 98. The bores 99 of the bearings 98 align with holes 100 in the ribs 96. A hinge pin 101 passes through holes 100 and the bores 99. A locking pin 102 extends through a traverse hole in one of the bearings 98 and the hinge pin 101. The bracket 97 has two spaced projections 103 which are shaped and positioned to fit into grooves 104 in the flanges 105 of an arch or frame member 106. Locking pins 107 pass through holes 108 in the flanges 105 and the projections 103. Grooves 104 correspond to the grooves 28 and 29 in FIG. 3.

The base plate 95 has holes 109 through which can be driven ground spikes, or through which can pass ground bolts screwing into an anchor in the ground, depending upon the desired level of fixing and the form of surface the structure is built on. For longer term holding, or more permanent holding on ordinary ground, deeply driven ground anchors can be used. These anchors are connected to the ground plate by cable or similar means. A problem arises if the anchors hit rock or if there is some impediment to deep driving. This can prevent the anchor being driven deep enough to tighten the cable. In the example, two pairs of small parallel ribs 110 are provided, a pair at each side of the base plate. Aligned bores 111 in the ribs 110 hold a rotatable pin 112. Pin 112 has a series of holes 113. A cable 114 is connected at one end to a ground anchor, shown in dotted outline at 115. At its other end, the cable has a short pin 116 which can be inserted into one of the holes 113. A further pin 117 can be inserted into one of a plurality of holes 118 extending through the pin 112. The pin 112 is inserted in the ribs 110, the pin 117 inserted into one of the holes 118, and the pin 112 rotated by the pin 117. The pin 112 will wind up any spare cable 114. The pin 112 is rotated until the cable is quite taut. A further pin 117 can then be inserted into a hole 118 to prevent unwinding. It is possible to use a much longer pin than pin 117 to wind up the cable, the short pin only being used to prevent unwinding.

Figure 3:
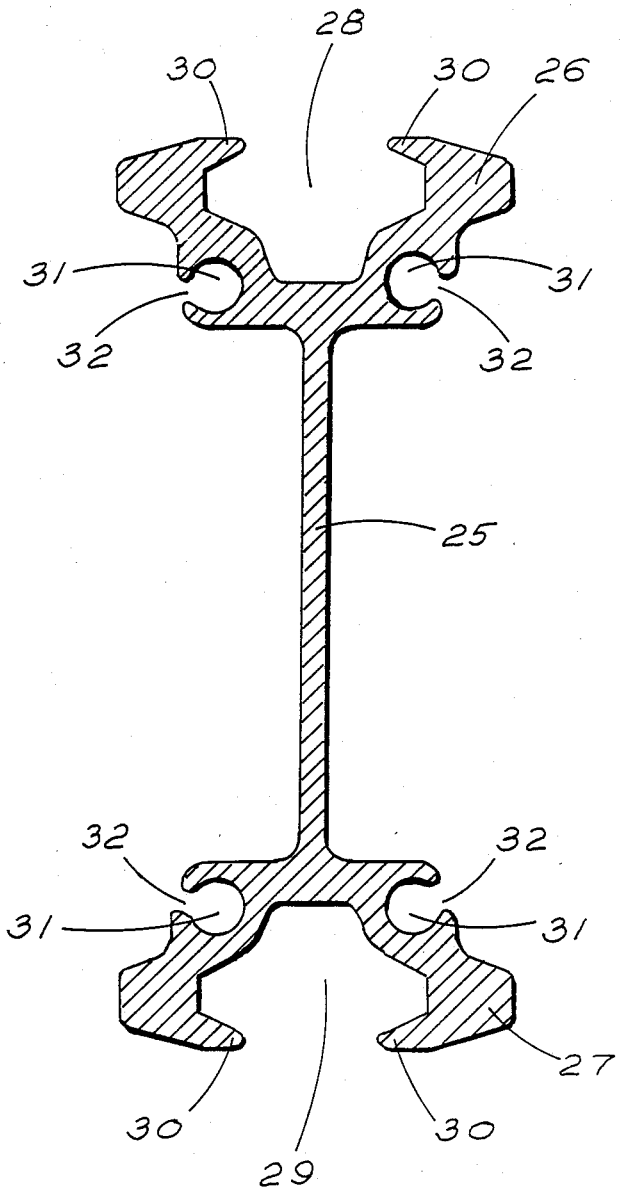
FIG. 3 is a cross-section through a beam illustrating its form.

The fabric panels are held at their edges by a roped or beaded edge sliding in the grooves 31 (FIG. 3). The panels are inserted in the outer grooves 31 in a frame. Initially, a rope or cable is positioned in each groove before the frame is raised. To insert a panel, the rope or cable is attached to the end of the roped or beaded edge. The other end of the rope or cable, at the other end of the frame, is attached to a winch which, on operation, pulls the rope or cable through the groove, pulling the panel edge along behind it. For a panel, a winch is provided on each frame, at each side of a panel.

Figure 20:
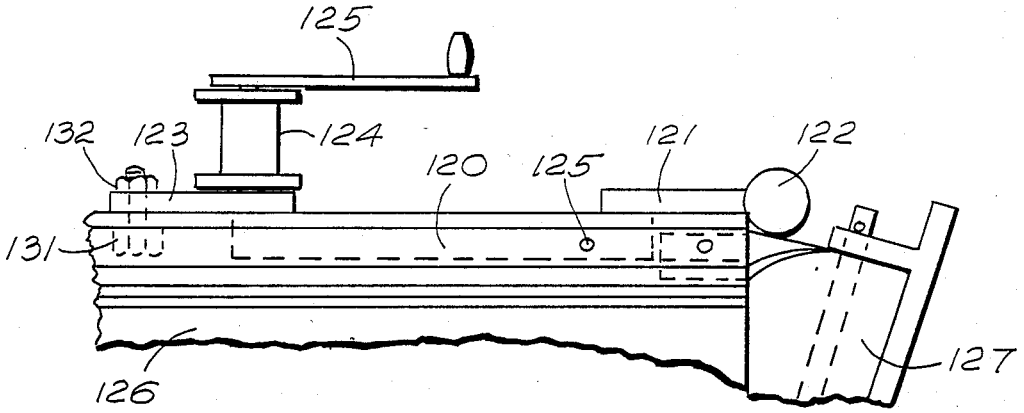
FIG. 20 is a side view of the winch mounted on a frame.
Figure 19:
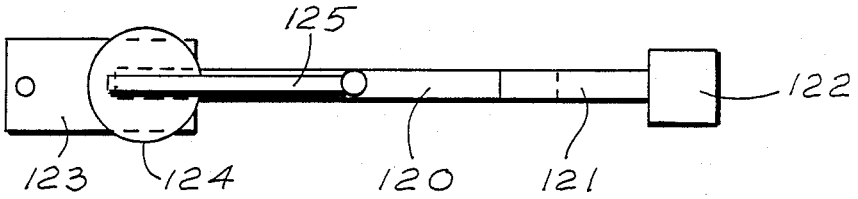
FIG. 19 is a top plan view of the winch in the direction of arrow B in FIG. 17.
Figure 17:
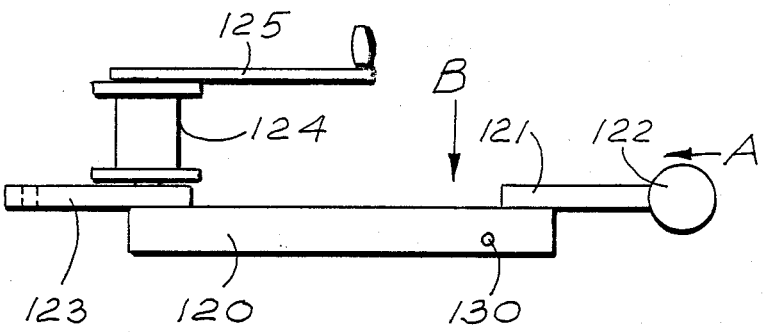
FIG. 17 is a side view of a winch for pulling in fabric panels.
Figure 18:
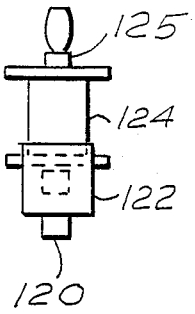
FIG. 18 is an end view of the winch in the direction of arrow A in FIG. 17.
Figure 21:
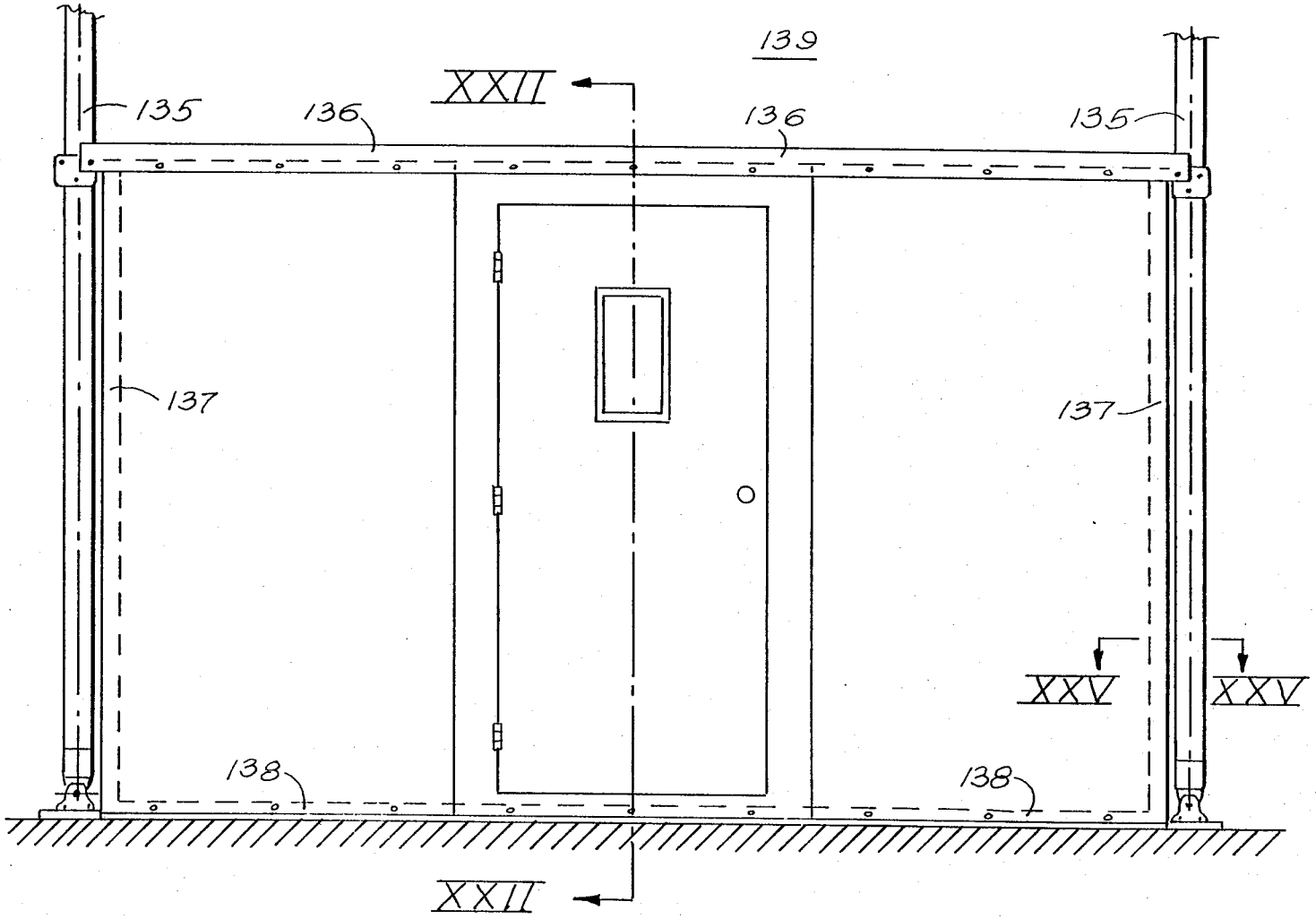
FIG. 21 is a front view of a door structure.
Figure 23:
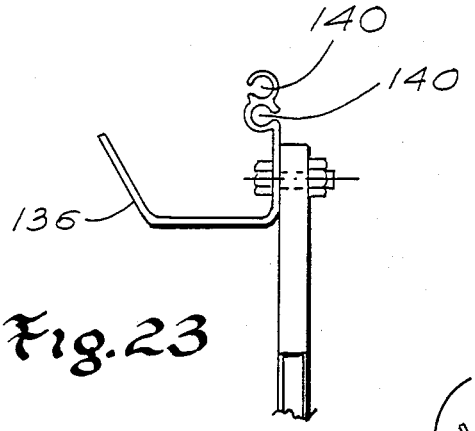
FIG. 23 is an enlarged view of the section in the circle X in FIG. 22.

FIGS. 17, 18 and 19 illustrate one form of a winch, and FIG. 20 shows the winch mounted on an arch. As illustrated in FIGS. 17, 18 and 19 a winch assembly comprises an elongate member 120 which is of a cross-section to fit into a groove in the outer surface of a frame. At one end is formed a first extension 121, on the free end of which is attached a cylindrical member 122. At the other end is attached a plate 123 which rests on the outer surface of a frame. Mounted on the plate 123 is a winch barrel 124 with a handle 125.

FIG. 20 illustrates the winch assembly in position on a frame. The frame is shown at 126. The winch assembly is positioned at the end of the frame, butting against the ground plate, shown at 127. The assembly is held in place at its end adjacent to the ground plate by a pin 128 passing through the web 129 of the frame and through a hole 130 (FIG. 17) in the member 120. At the other end the winch assembly is held in pace by a hold-down bolt 131 positioned in the groove in the frame and a nut 132 screwing onto the bolt 131. The rope or cable from the slot in the frame is fed back over the cylindrical member 122 to the winch 124. Once the panel is in position, the winch can be removed. A winch will normally pull in the adjacent edges of the panels on either side of a frame, one panel being positioned first and then the other panel pulled into place.

Figure 25:
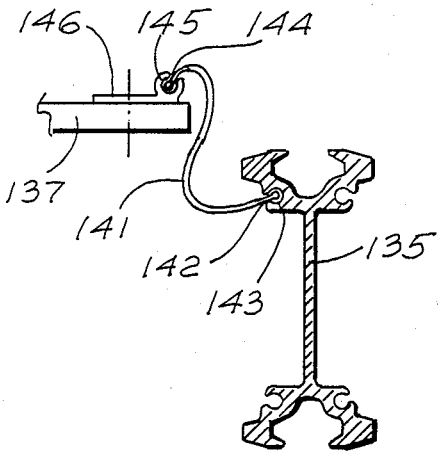
FIG. 25 is a cross-section on the line XXV—XXV of FIG. 21.
Figure 22:
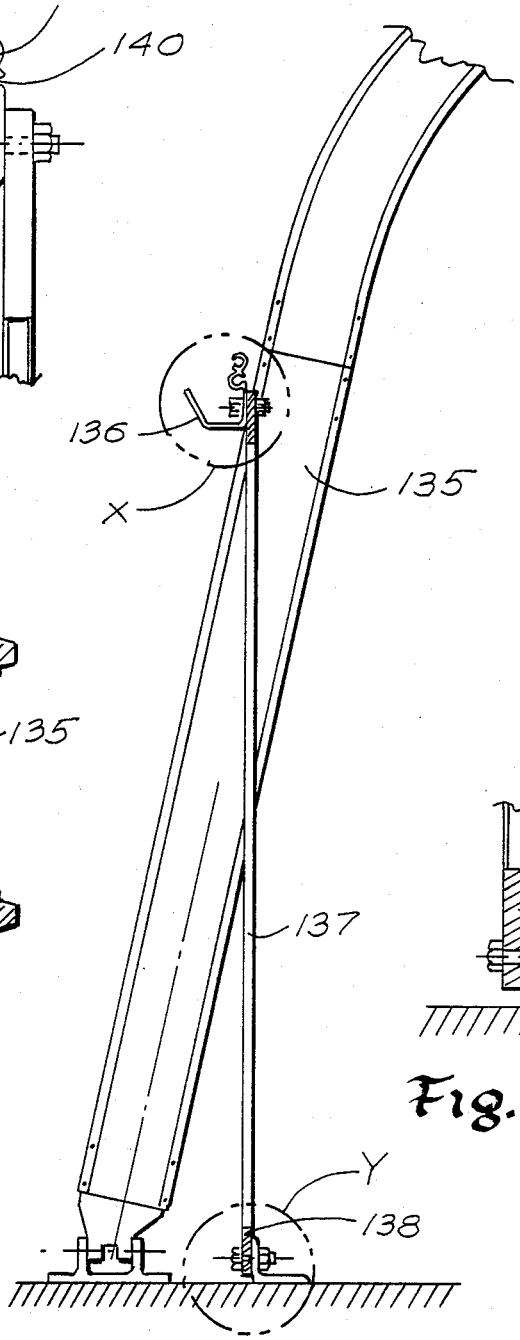
FIG. 22 is a cross-section on the line XXII—XXII of FIG. 21.
Figure 24:
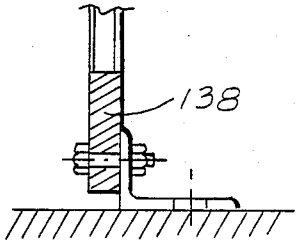
FIG. 24 is an enlarged view of the section in the circle Y in FIG. 22.

Side doors can be provided between pairs of frames. At the position for a door, a length of rain gutter is attached to the frames at a height to provide enough headroom. This is illustrated in FIGS. 21, 22, 23 and 24, where adjacent arches are indicated at 135. The rain gutter is shown at 136 with a typical cross-section of the rain gutter in larger scale in FIG. 23. A slide framing member 137 is attached to each frame, and a bottom frame member 138 extends at a ground level as seen in FIG. 24. The frames 135 are slightly inclined upwardly and inwardly at the door position, while the door is vertical, as seen in FIG. 22. The bottom edge of the panel 139 finishing at the top of the door position is fastened into one of two keyhole slot formations 140 on the inner or back wall of the rain gutter. Normally the bottom edge of the panel would be fastened into the upper slot 140. It will be appreciated that there will be a triangular shaped gap between each arch and the adjacent slide framing member 137. The gap filled with a triangular panel having the long edges of roped or beaded form. One edge is positioned in the slot in the frame and the other edge is positioned in a slot formed as part of a bracket attached to the side framing member 137. This is seen in FIG. 25, where a panel 141 has one edge 142 in a slot 143 in frame 135 and the other edge 144 in a slot 145 on a bracket 146. In an alternative arrangement, the edges of the triangular panel can be held in the slots by gripping members, described later.

Figure 27:
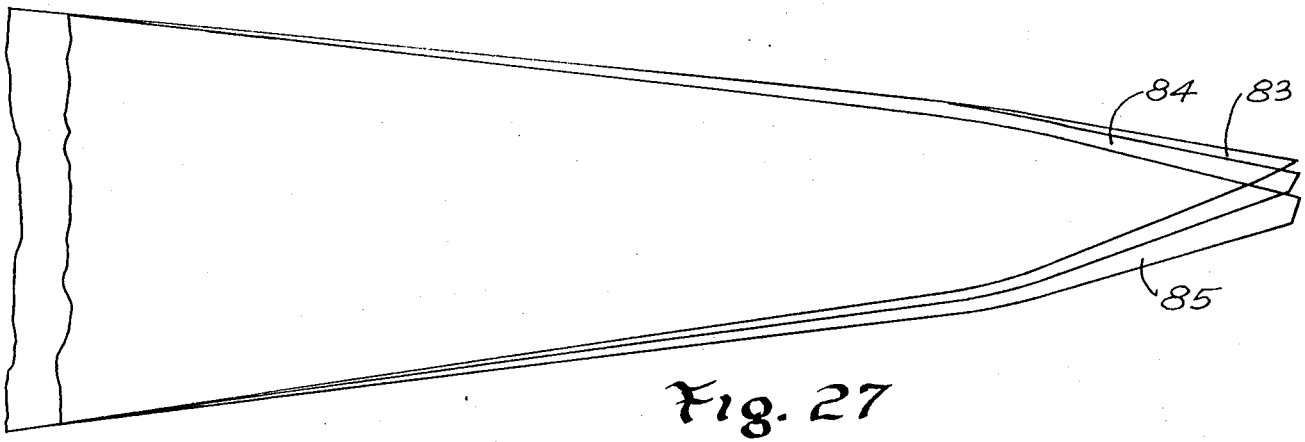
FIG. 27 illustrates the plan forms of the fabric panels for the closure of FIG. 26, approximately half of each panel shown, superimposed one upon another.

In FIG. 14 an end closure is illustrated, composed of three frames 80, 81 and 82, with fabric panels 83, 84 and 85. It will be appreciated that each panel tapers towards its ends, from the center. In the example illustrated, the frames are positioned to be the same distance apart at the centers of the frames. However there is some slight variation in the shapes of the panels. This is illustrated in FIG. 27, which shows the three panels 83, 84 and 85 superimposed on one another. Approximately half of each panel is shown, with one end, the other half being similar.

Figure 28:
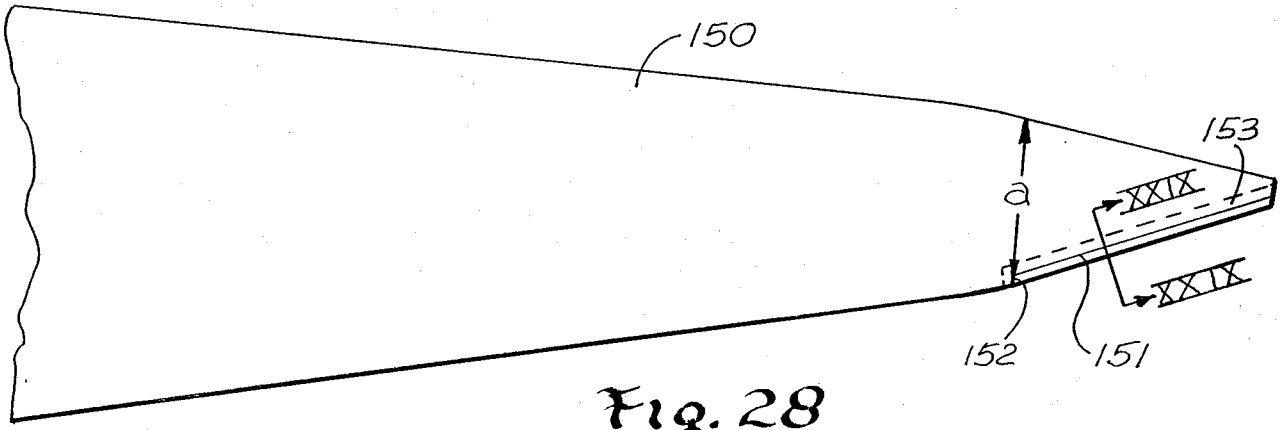
FIG. 28 illustrates the plan form of a modified panel for common use, approximately half a panel shown.

The differences in shape are quite small, relative to the overall sizes of the panels. It is possible to attempt to install the wrong panel between two frames. The ability to have only one shape of panel is advantageous. This is obtained by forming the ends of a panel as a compromise and this is a slight variation from the shape of panel 84, and is illustrated in FIG. 28 at 150.

Figure 29:
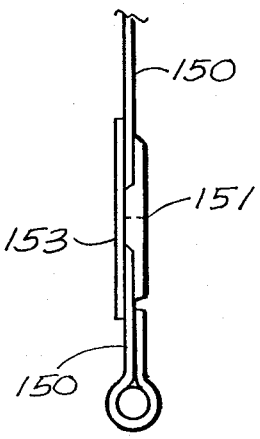
FIG. 29 is a cross-section on the line XXIX—XXIX in FIG. 28.

A further problem is installing the panels. As stated, the panels are held in the frames by roped or beaded edges which fit in keyhole section slots in the frames. The panels are installed by inserting one end of a panel at one end of each of an adjacent pair of frames and then the panels are pulled into position by ropes or cables previously positioned in the grooves and attached to the panel. However, in a door structure as in FIG. 14, the panels obviously cannot be pulled in with the door in the closed position, as in FIG. 14. The frames must be lifted up so that the narrow end of a panel can go up and over, between the frames and then down the other side. This is extremely difficult. In the present invention, this problem is eased by providing a slide fastener along one edge of each panel, at each end. The length of fastener is such that it can conveniently be closed by hand once the panels are installed, and the door closed. A typical length is about 7 feet, although this can vary. Lengths less than this can be used. A slide fastener is indicated at 151 in FIG. 29. At the upper end 152 of the fastener, the width of the panel is indicated as "a" and the frames 80, 81 and 82 need only be lifted up so that the maximum distance between frames and between frame 82 and frame 11, is slightly less than "a". This would be at the centers of the frames. A cross-section through the fastener is shown in FIG. 29. A flap 153 can be provided to extend over the fastener. This is indicated in dotted outline in FIG. 28.

Figure 26:
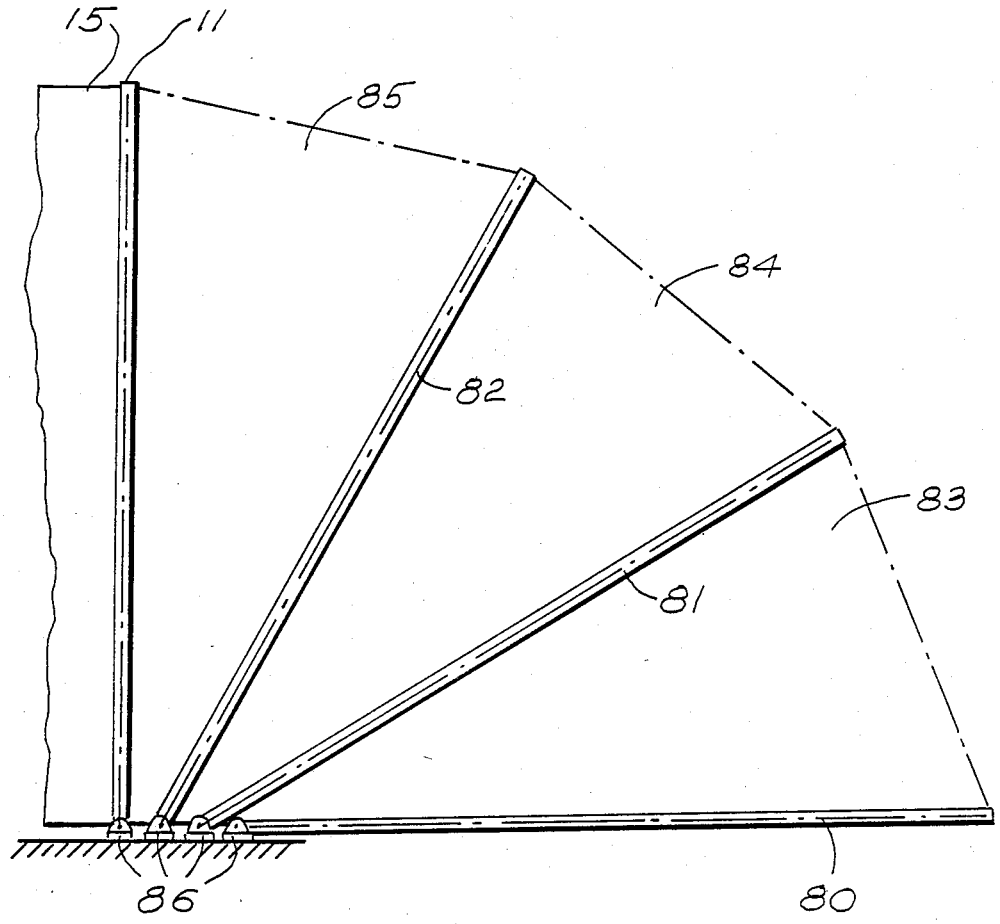
FIG. 26 is a side view of an openable closure.

When a door is opened, the cross-panel material folds down between the frames. With quite wide panels being used, this downward hanging of the panel material can severely restrict the free height of the door opening. One or more brailing ropes can be positioned between frames. As an example, one end of a brailing rope is attached to the lowest frame of the door—frame 80 in FIG. 26. The rope is passed through holes in the frames 81 and 82 and through a pulling or other means on frame 11. When the door is opened, with frames 80, 81 and 82 pivotted upward, pulling on the brailing rope will pull up the panel material. One brailing rope can be provided on the structure center line, or a plurality of ropes can be provided, spaced around the frames.

FIGS. 30 to 34 illustrate an alternative arrangement for attaching edges of panels to frames. The arrangement makes use of the keyhole section slot or groove 31 (FIG. 3) formed in each flange of a frame. A gripping insert is used, the insert having a channel or Vee-shaped cross-section.

Figure 30:
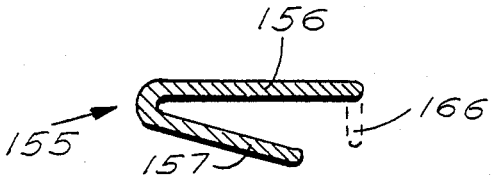
FIGS. 30 and 31 illustrate a gripping member for alternate use in attaching a panel edge to a frame, FIG. 30 being a cross section on line XXX—XXX on FIG. 31.
Figure 31:
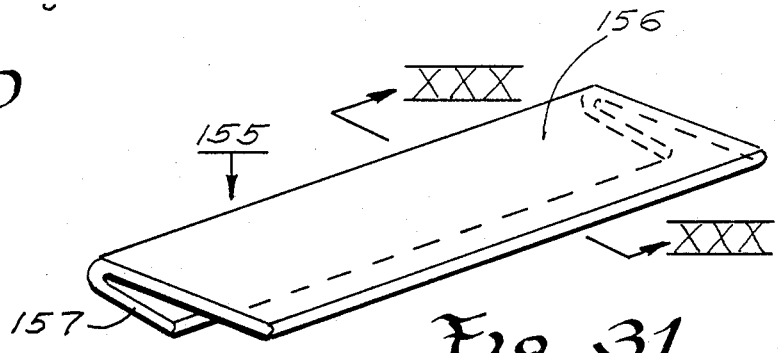

FIGS. 30 and 31 illustrate an insert 155 which is of a channel shape in cross-section, in the example Vee-shaped, the shape defined by outer and inner legs 156 and 157 joined at the root of the Vee. In the example, outer leg 156 is longer than the inner leg 157. The inner leg 157 is of a length that it can be positioned entirely within a groove.

Figure 32:
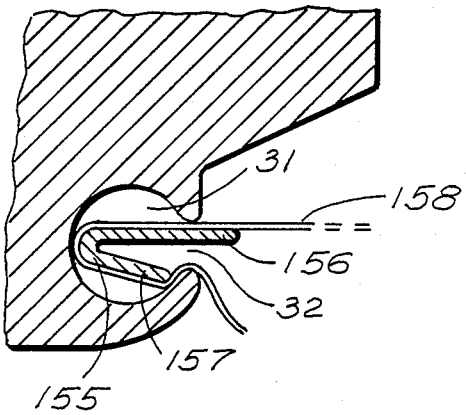
FIGS. 32, 33 and 34 illustrate three stages in the positioning of a gripping member in attaching a panel edge.
Figure 33:
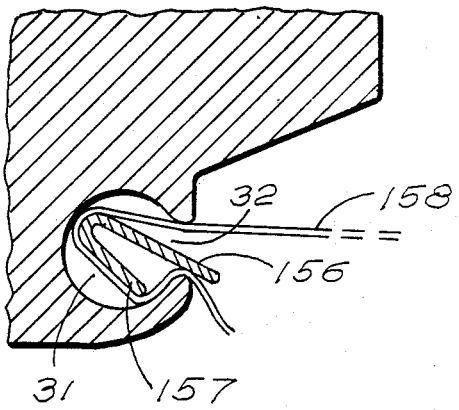
Figure 34:
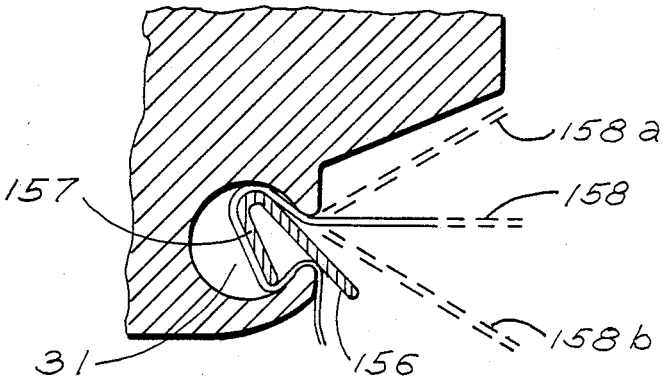

FIGS. 32, 33 and 34 illustrate three sequential positions of an insert in a groove as a panel is attached. In FIG. 32, a free edge of a panel 158 has been wrapped round an insert 155 and the insert and panel edge pushed into groove 31. The spacing or spread of the legs 156 and 157 is such that the inner leg is deflected toward the outer leg slightly as the insert is pushed in. As tension occurs on the panel, the insert is rotated—an intermediate position illustrated in FIG. 33—until the insert rotates to a position where the inner leg is jambed across the opening 32, as illustrated in FIG. 34. The panel is gripped between the insert and the groove wall. While the panel normally extends straight out from the groove, it can extend at an angle, as illustrated in dotted outline in 158*a* and 158*b*.

Figure 35:
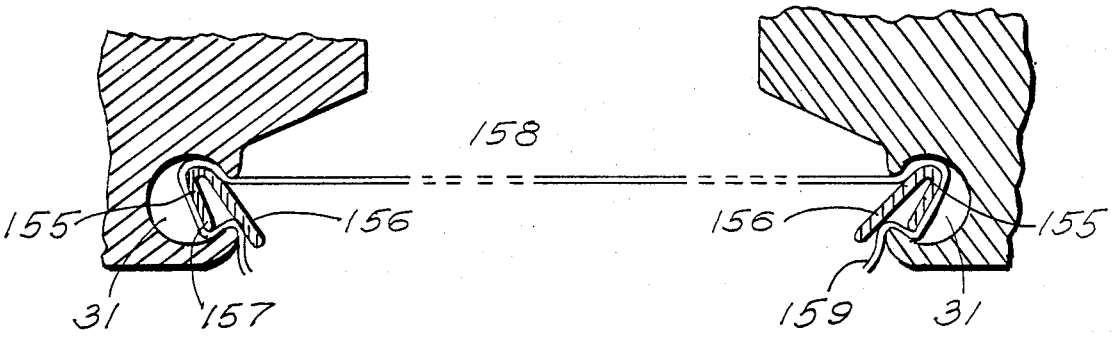
FIG. 35 illustrates a panel attached to two frames by gripping members.

FIG. 35 illustrates a panel 158 in position between two frames. The panel is gripped at each edge by an insert 155 in each groove 31. Generally, one insert 155 is positioned in a groove, with one edge of the panel, the panel pulled to cause the insert to rotate to the gripping position. The other insert, with the other edge of the panel, is inserted into the other groove, the free edge of the panel, for example the edge indicated at 159, being pulled while the insert is held in position to apply tension to the panel. On release of the edge and insert, the insert will rotate and grip the edge. Alternatively, the second edge of the panel is wrapped round the insert and the insert and panel edge pushed into the groove with the panel taut, possibly to the extent that some slight stretch is applied to the panel. On release of the insert, held by the leg 157, the insert will rotate and grip the panel material.

Figure 36:
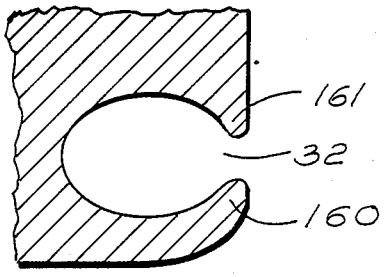
FIGS. 36 and 37 illustrate two alternate forms of grooves in a frame.
Figure 37:
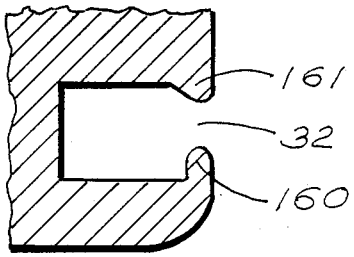

While the slots or grooves 31 have been shown circular, other forms can be used. FIGS. 36 and 37 illustrate an oval groove and a rectangular groove, respectively. One requirement is the restricted opening or throat 32. Another requirement is an inner lip, as indicated at 160, behind which the inner leg 157 of the insert lodges on rotation of the insert. Some form of lip is also needed on the other side of the opening, as indicated at 161, to cause the insert to rotate as tension is applied on the panel.

The form of the insert can vary, although it will be of generally channel-shaped cross-section. The legs 156 and 157 can be varied in their angular relationship, including being parallel. The requirement is that the inner leg be capable of engaging behind the inner lip 160.

Figure 38:
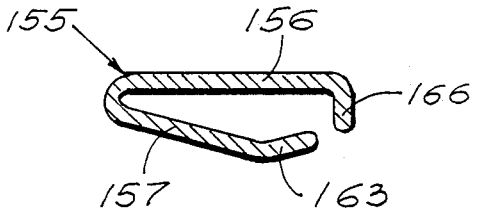
FIGS. 38 and 39 illustrate various modifications to a gripping member.

Once installed, the insert is held firmly in place by the tension in the panel. To assist in removal of the insert, the end section of the inner leg can be inclined towards the outer leg, as illustrated at 163 in FIG. 38. The end of the inner leg still engages behind the lip 160, but on rotation of the insert toward a free position, for example as in FIG. 32, the section 163 assists in causing the inner leg to deflect towards the outer leg and the insert to pass through the restricted opening 32.

Figure 39:
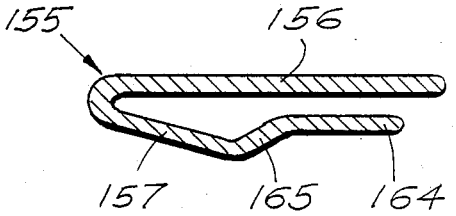

Another form of insert is seen in FIG. 39. In this form, the inner leg 157 is extended at 164, the extension also extending out through the opening. Between the extension 164 and the inner leg 157 there is an abutment part 165. Abutment part 165 engages behind the lip 160 when the insert is in position. The extension 164 eases withdrawal of the insert in that the extension can be urged toward the outer leg 156, by pliers or other gripping member. This deflects the inner leg 157 toward the outer leg 156, easing removal of the insert.

An extension can also be formed on the outer leg 156, extending generally normal to the outer leg towards the inner leg. Such an extension is indicated at 166 in FIG. 38 and also in dotted outline at 166 in FIG. 30. A lever can be inserted between the extension 166 and the frame to force the insert out. Other informations can be provided at the end of the outer leg to assist in removal of an insert.

The action of the insert is to rotate in the groove under the action of the tension in the panel and jamb across the groove behind the throat. To permit removal, at least the outer leg extends through the throat to permit rotation of the insert against any panel tension and to pull the insert out through the throat.

The insertion has particular use in attaching panels to frames of building structures composed of a number of spaced parallel frames. One such structure could be for greenhouses. The use of frames having two sets of grooves permits attachment of two spaced panels, for various uses.

What is claimed is:

1. A frame structure comprising a plurality of parallel, spaced apart, arched frame assemblies, each frame assembly comprising a pair of parallel closely spaced frames, each frame having a transverse cross-section including a web section extending in a direction parallel to the plane of the frame span; a flange at an outer end of the web section extending laterally on each side at the center end of the web section; and an enclosed groove extending the length of the frame on each side of said web section at said flange, a slot extending through a wall of each groove to provide communication therewith; means connecting the frames of a pair a fixed distance apart at spaced positions along the frames comprising a male plug member on the inner, opposed, surfaces of said web section; a spacer tube engaging at each end over said plug members; and a plate member extending over and attached to the frame; ground support means extending in two spaced apart lines to form support surfaces spaced predetermined distances apart and fastened to the ground, a ground support means for each end of each frame; means at each end of each frame pivotally attaching each end of each frame to the related ground support means; a plurality of wide fabric panels extending between each pair of frames, and a plurality of narrow fabric panels extending between the frames of each pair of frames, the fabric panels including integral tensioning means, each said fabric panel having a beaded edge along each side, the beaded edges positioned in said grooves and the panel extending through said slots.

2. A structure as claimed in claim 1, said predetermined distances comprising alternatively a first narrow distance corresponding to the distance between the frames of a pair and a second, wider, distance corresponding to the distance between the opposed frames of spaced pairs of frames.

3. A structure as claimed in claim 2, including at least one fixed length rigid spacer extending between each pair of frames, said rigid spacers being pivoted at each end to opposed frames of adjacent pairs, and having a length equal to said second, wider, distance between opposed frames of spaced pairs of frames.

4. A structure as claimed in claim 1, said transverse cross-section further including a further flange at the inner end of the web section extending laterally on each side at the inner end of the web section.

5. A structure as claimed in claim 4, including a further enclosed groove extending the length of the frame on each side of the web section at said further flange, a slot extending through a wall of each further groove to provide communication therewith.

6. A structure as claimed in claim 5, each flange having a central groove formed in and extending into each web, each groove having a reduced width opening to form partially enclosed grooves.

7. A structure as claimed in claim 1, including a captive nut positioned in each partially enclosed groove in the lateral edges of said flanges, and bolts extending through said plate members and into said nuts to attach said plate members to said frames.

8. A structure as claimed in claim 7, each said frame composed of a plurality of sections in butting relationship a male plug member positioned on the inner surface of each web section adjacent each end of a section and a spacer tube engaging over the plug members adjacent the ends of the section; said plates extending over the butting ends of adjacent sections and attached to the butting ends of the adjacent sections to hold said sections together.

9. A structure as claimed in claim 8, including a plate member on both sides of a pair of frames.

10. A structure as claimed in claim 9, including an alignment member positioned in each said central groove at the joint between sections, said alignment members bridging said joint.

11. A structure as claimed in claim 1, wherein said panels extend in one unit for the complete span of said frames.

12. A structure as claimed in claim 6, each said ground support means comprising a base plate; a pair of parallel upstanding ribs on said base plate; aligned holes in said ribs; a bracket positioned between said ribs, a bore in said bracket in alignment with said holes and a hinge pin extending through said holes and said bore and projections on said bracket positioned to fit into said central grooves formed in each web.

13. A structure as claimed in claim 12, including two further, small, parallel ribs at one side of said base plate; a pin rotatably mounted in said small ribs; a cable attached to a ground anchor and means for rotating said pin to wind up spare cable.

14. A structure as claimed in claim 1, including means for attaching side edges of said panels to said frames, comprising an insert for positioning in said enclosed groove, said insert of channel shape having inner and outer legs, the inner leg of a length for positioning within said enclosed groove, the outer leg of a length to extend through said slot in said wall of said enclosed groove, the legs inclined to one another whereby on insertion of the insert, said inner leg snaps into said enclosed groove, the fabric panel edge passing round said insert, the panel main body and the panel edge exiting through said slot; the arrangement such that tension in the panel rotates said insert, the inner leg jamming across the slot inside the groove, the panel gripped between the insert and the wall of the groove.

15. A frame structure comprising a plurality of parallel, spaced apart, arched frame assemblies, each frame assembly comprising a pair of parallel closely spaced frames and means connecting the frames of a pair a fixed distance apart at spaced positions along the frames; ground support means extending in two spaced apart lines to form support surfaces spaced predetermined distances apart and fastened to the ground, a ground support means for each end of each frame; means at each end of each frame pivotally attaching each end of each frame to the related ground support means; a plurality of wide fabric panels extending between each pair of frames, and plurality of narrow fabric panels extending between the frames of each pair of frames, the fabric panels including integral tensioning means, said tensioning means comprising inflatable portions in said panels, said inflatable portions extending for the span of the frames.

16. A structure as claimed in claim 15, including a plurality of inflatable portions in each said wide fabric panel, and a single inflatable portion in each narrow fabric panel.

17. A frame structure comprising a plurality of parallel, spaced apart, arched frame assemblies, each frame assembly comprising a pair of parallel closely spaced frames and means connecting the frames of a pair a fixed distance apart at spaced positions along the frames; ground support means extending in two spaced apart lines to form support surfaces spaced predetermined distances apart and fastened to the ground, a ground support means for each end of each frame; means at each end of each frame pivotally attaching each end of each frame to the related ground support means; a plurality of wide fabric panels extending between each pair of frames, and a plurality of narrow fabric panels extending between the frames of each pair of frames, the fabric panels including integral tensioning means, and including a door structure at at least one end, said door structure comprising a plurality of arched end fames and at least one end ground plate at each side, said end frames pivotally attached at their ends to said end ground plates, said end frames extending successively from horizontal up towards vertical, and segmental fabric panels extending between the end frames, said panels having a common shape, and a slide fastener at each end of each panel.

* * * * *